US009187816B2

(12) United States Patent
Pope et al.

(10) Patent No.: US 9,187,816 B2
(45) Date of Patent: Nov. 17, 2015

(54) METHODS OF RESIZING HOLES

(71) Applicant: GENERAL ELECTRIC COMPANY, Schenectady, NY (US)

(72) Inventors: Stephen Gerard Pope, Roebuck, SC (US); Dennis William Cavanaugh, Palm Beach Garden, FL (US); John Gregory Obeirne, Houston, TX (US); Eric Eicher McConnell, Easley, SC (US); Mark Lawrence Hunt, Simpsonville, SC (US); Canan Hardwicke, Greenville, SC (US)

(73) Assignee: General Electric Company, Schenectady, NY (US)

( * ) Notice: Subject to any disclaimer, the term of this patent is extended or adjusted under 35 U.S.C. 154(b) by 463 days.

(21) Appl. No.: 13/669,754

(22) Filed: Nov. 6, 2012

(65) Prior Publication Data

US 2014/0124100 A1 May 8, 2014

(51) Int. Cl.

| | |
|---|---|
| ***C23C 10/20*** | (2006.01) |
| ***C23C 22/58*** | (2006.01) |
| ***C23C 10/18*** | (2006.01) |
| ***C23C 10/28*** | (2006.01) |
| ***C23C 10/60*** | (2006.01) |
| ***F23R 3/28*** | (2006.01) |

(52) U.S. Cl.

CPC ..... *C23C 10/18* (2013.01); *C23C 10/20* (2013.01); *C23C 10/28* (2013.01); *C23C 10/60* (2013.01); *F23R 3/286* (2013.01); *F23C 2900/07001* (2013.01); *F23D 2212/00* (2013.01); *F23D 2900/14004* (2013.01); *F23R 2900/00018* (2013.01); *F23R 2900/00019* (2013.01)

(58) Field of Classification Search

CPC ..... C23C 22/73; C23C 8/04; C23C 10/18; C23C 10/20; C23C 10/60; F23R 3/286; F23R 2900/18; F23R 2900/19; F23R 2900/7001; F23D 2212/00; F23D 2900/14004

See application file for complete search history.

(56) References Cited

U.S. PATENT DOCUMENTS

| | | | | |
|---|---|---|---|---|
| 7,377,036 | B2 | 5/2008 | Johnson et al. | |
| 2003/0152705 | A1 * | 8/2003 | Pfaendtner et al. | 427/376.1 |
| 2004/0115355 | A1 | 6/2004 | Bauer et al. | |
| 2009/0126833 | A1 | 5/2009 | Cavanaugh et al. | |
| 2010/0136240 | A1 | 6/2010 | O'Connell et al. | |

FOREIGN PATENT DOCUMENTS

| | | | |
|---|---|---|---|
| EP | 2060653 | A2 | 5/2009 |

OTHER PUBLICATIONS

Copy of European Search Report and Written Opinion issued in connection with corresponding EP Application No. 13191650.4-1602 dated Feb. 11, 2014.

* cited by examiner

*Primary Examiner* — Lois Zheng

(74) *Attorney, Agent, or Firm* — Ernest G. Cusick; Gary M. Hartman; Domenica N. S. Hartman

(57) ABSTRACT

Methods of reducing an initial cross-sectional area of a hole in a component to a predetermined cross-sectional area including preparing a composition comprising at least an aluminum alloy with a melting temperature higher than aluminum, applying the composition to an interior surface of the hole, and then heating the component to cause a metal within the component to diffuse from the component into the composition and react with the aluminum alloy in the composition to form a coating on the interior surface of the hole. The heating step is performed to selectively modify the initial cross-sectional area of the hole and thereby directly attain the predetermined cross-sectional area thereof.

20 Claims, 5 Drawing Sheets

METHODS OF RESIZING HOLES

BACKGROUND OF THE INVENTION

The present invention generally relates to methods for modifying the cross-sectional area of a hole. More particularly, this invention relates to a coating process that can be controlled to selectively resize a hole, a nonlimiting example being a premix fuel supply hole of a fuel nozzle assembly of a gas turbine.

In gas turbines, a fuel nozzle typically comprises a subassembly of generally concentric tubes defining a central passage for supplying diffusion fuel gas and a pair of concentric passages for supplying premix fuel gas. Spaced from and surrounding the subassembly is an inlet flow conditioner for directing and confining a flow of inlet air past a plurality of circumferentially spaced vanes carried by the subassembly. The vanes are in communication with the concentric fuel gas supply passages. Particularly, the vanes include outer and inner premix fuel supply holes for supplying gas from the respective passages for mixing with the inlet air. The gas fuel mixture is swirled by the vanes downstream of the premix fuel supply holes for subsequent combustion.

FIGS. 1, 2 and 3 represent a non-limiting example of a conventional fuel nozzle assembly 10 for a land-based gas turbine in accordance with an aspect of the invention. Generally, the fuel nozzle assembly 10 includes a subassembly 28 and a surrounding air inlet conditioner 30. The subassembly 28 includes a central tube 12 and a pair of concentric tubes 14 and 16 defining therebetween discrete annular fuel passages 18 and 20. The central tube 12 supplies diffusion gas to a combustion zone (not shown) located downstream of the fuel nozzle assembly 10. The subassembly 28 further includes a plurality of vanes 22 that are shown in FIG. 2 as circumferentially spaced from each other around the outer tube 16. The vanes 22 include outer premix fuel supply holes 24 supplied with gaseous fuel from the passage 20 and a plurality of inner premix fuel supply holes 26 supplied with gaseous fuel from the passage 18. As best seen in FIGS. 2 and 3, each vane 22 has a pair of outer and inner plenums 32 and 34, respectively, confined between opposite side walls 36 and 38 of the vane 22. The holes 24 and 26 are fluidically connected with the passages 20 and 18 through the outer and inner plenums 32 and 34, respectively.

As represented in FIG. 2, the outer premix fuel supply holes 24 include a pair of radially spaced premix fuel supply holes 24 through one wall 36 of the vane 22 and a single premix fuel supply hole 24 through the opposite side wall 38 of the vane 22. Downstream portions 40 of the vanes 22 are represented in FIG. 2 as twisted to impart a swirl to the flow of premixed air and gaseous fuel flowing between the subassembly 28 and the inlet flow conditioner 30, the gaseous fuel being supplied to the air stream via the outer and inner premix fuel supply holes 24 and 26, respectively.

The gas fuel composition and Wobbe Index (an indicator of the interchangeability of fuel gases) at site locations determine the fuel gas nozzle exit velocity requirement, which in turn is dependent upon the premix fuel supply hole size. Where the premix fuel supply holes 24 are too large for a given gas composition and Wobbe Index, nozzle dynamics become a concern. This oversized orifice may be the result of wear or a mistake in original orifice dimension. Typically, as in the case of the fuel nozzle assembly 10, one or more of the premix fuel supply holes 24 being oversized may deem the part unusable for its intended purpose.

One method of repair for the fuel nozzle assembly 10 is to take it apart, replace the vane 22 with the oversized premix fuel supply holes 24, and re-assemble the nozzle assembly 10. This can be an expensive way to salvage an otherwise unusable part and can result in scrapping of the fuel nozzle assembly 10 under some situations. Another method involves inserting plugs into the premix fuel supply holes 24 and securing them to the vane 22, possibly using a braze technique. New holes are formed through at least three of the plugs to diameters less than the diameter of the original premix fuel supply holes 24. Thus, the original premix fuel supply holes 24 are resized to provide smaller holes with consequent desired tuning effects. Yet another method includes welding the premix fuel supply holes 24 shut and then trying to find the original locations so they can be re-drilled to a smaller size.

All of the above solutions can be expensive and time consuming, among other individual disadvantages. For example, solutions that involve techniques such as welding can be difficult to perform without damaging the vane 22 and braze joints that may have been used to fabricate the assembly 10.

In view of the above, it can be appreciated that there is a need for an improved method of resizing premix fuel supply holes of fuel nozzle assemblies for gas turbine engines, as well as other types of holes whose cross-sectional area must be controlled. It would be particularly advantageous if such a method were capable of requiring less effort and expense than techniques such as welding, which can damage components of a complex device.

BRIEF DESCRIPTION OF THE INVENTION

The present invention provides methods suitable for modifying the cross-sectional areas of holes within complex devices, including but not limited to premix fuel supply holes of gas turbine fuel nozzle assemblies.

According to a first aspect of the invention, a method of reducing an initial cross-sectional area of a hole in a component to a predetermined cross-sectional area includes preparing a composition comprising at least an aluminum alloy with a melting temperature higher than aluminum, applying the composition to an interior surface of the hole, and then heating the component to cause a metal within the component to diffuse from the component into the composition and react with the aluminum alloy in the composition to form a coating on the interior surface of the hole. The heating step is performed to selectively modify the initial cross-sectional area of the hole and thereby directly attain the predetermined cross-sectional area thereof.

According to a second aspect of the invention, a method of tuning a fuel nozzle assembly for a gas turbine having a plurality of circumferentially spaced vanes with holes through walls of the vanes for flowing fuel for premixing with air within the nozzle assembly includes preparing a composition comprising at least an aluminum alloy with a melting temperature higher than aluminum, applying the composition to an interior surface of at least a first of the holes within an individual vane of the plurality of vanes, the first hole being in an oversized condition that causes fuel flowing therethrough to flow at a flow rate that is higher than a predetermined flow rate for the first hole, and then heating the vane to cause a metal within the vane to diffuse from the vane into the composition and react with the aluminum alloy in the composition to form a coating on the interior surface of the first hole. The heating step is performed to selectively modify a cross-sectional area of the first hole and thereby directly attain the predetermined flow rate thereof.

According to a third aspect of the invention, a method is provided for reducing an initial cross-sectional area of a flow path defined as a gap between at least two mating components to a predetermined cross-sectional area. The method includes preparing a composition comprising at least an aluminum alloy with a melting temperature higher than aluminum, applying the composition to an interior surface of a first component of the two mating components and/or an exterior surface of a second component of the two mating components to yield coated components, and then heating the coated components to cause a metal within the coated components to diffuse from the coated components into the composition and react with the aluminum alloy in the composition to form a coating on the interior surface of the first component and/or the exterior surface of the second component. The heating step is performed to selectively modify the initial cross-sectional area of the flow path and thereby directly attain the predetermined cross-sectional area thereof.

A technical effect of the invention is the ability to resize the cross-sectional area of one or more holes within a complex device, such as fuel nozzle assembly of a gas turbine engine, while avoiding techniques, such as welding, that can damage components of the complex devices.

Other aspects and advantages of this invention will be better appreciated from the following detailed description.

DETAILED DESCRIPTION OF THE INVENTION

Figure 1:
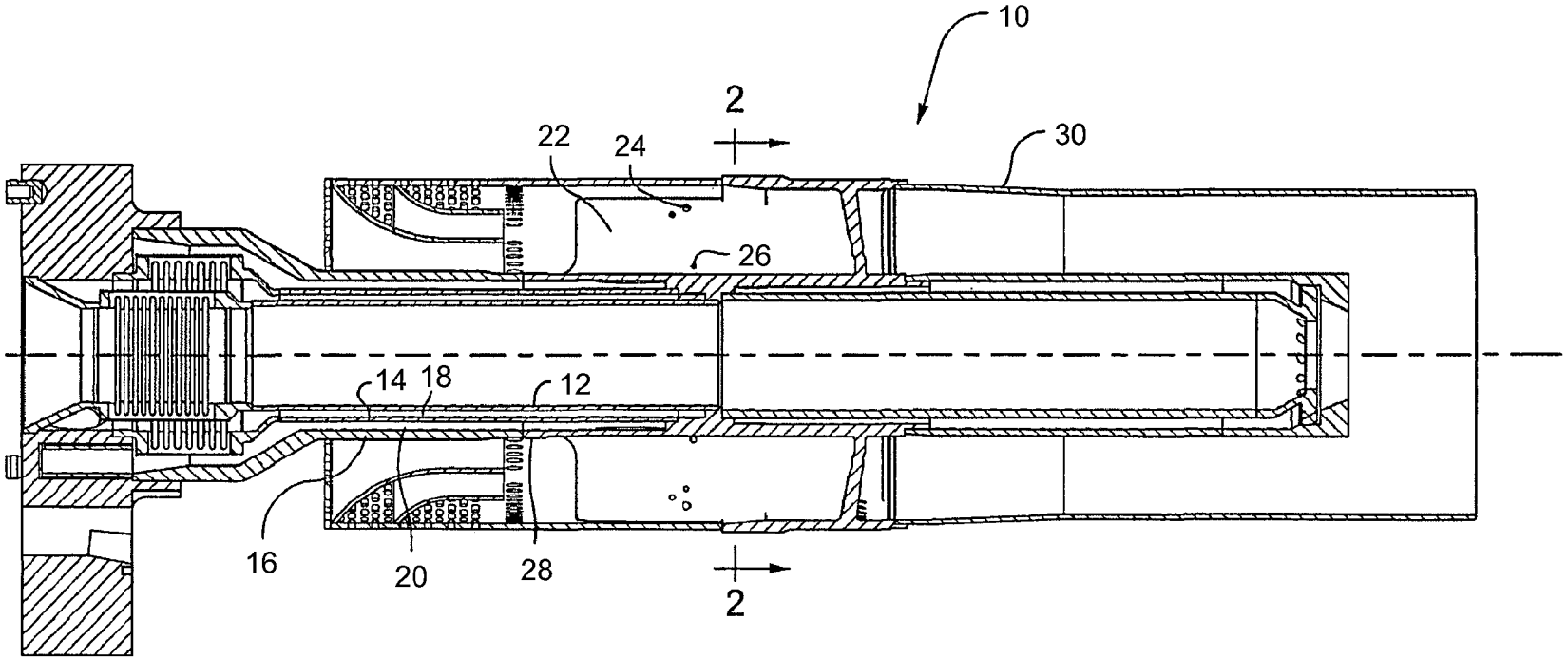
FIG. 1 (Prior Art)
FIG. 1 is a cross-sectional view representing a fuel nozzle assembly for a gas turbine of a type known in the art.
Figure 2:
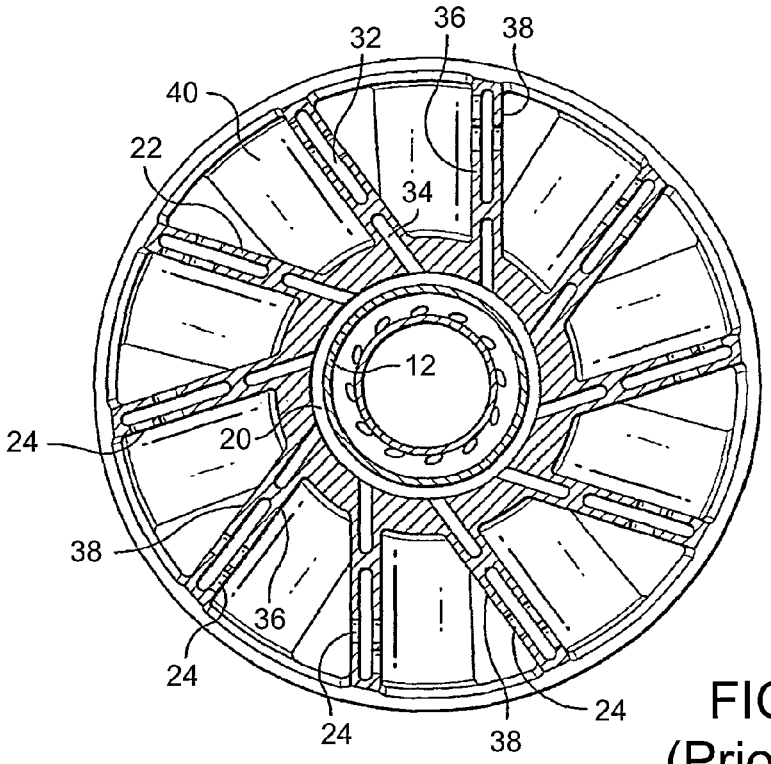
FIG. 2 (Prior Art)
FIG. 2 is a cross-sectional view of the fuel nozzle assembly of FIG. 1 taken along line 2-2 and representing premix fuel gas supply holes in walls of vanes of the fuel nozzle assembly.
Figure 3:
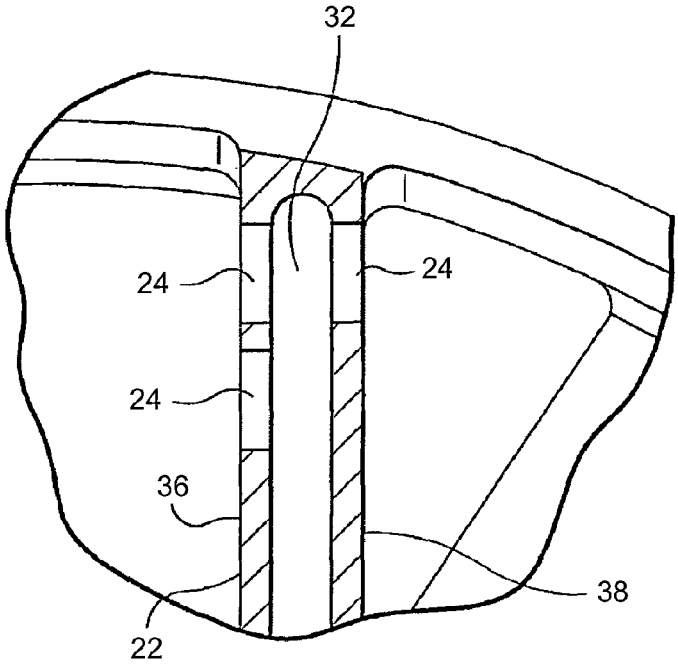
FIG. 3 (Prior Art)
FIG. 3 is an enlarged cross-sectional view of the premix fuel gas supply holes of an individual vane from FIG. 2.
Figure 4:
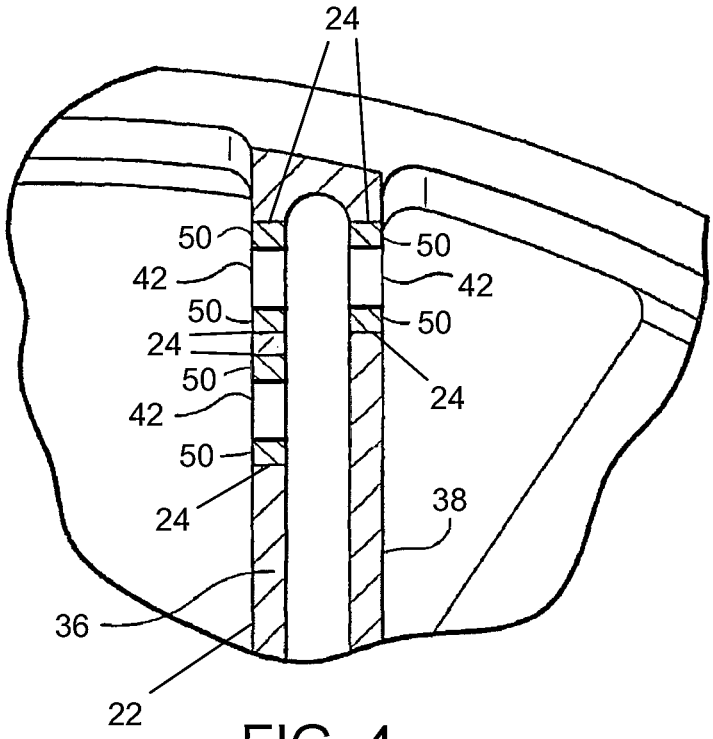
FIG. 4 is an enlarged cross-sectional view of premix fuel supply holes of an individual vane of the type shown in FIG. 2 wherein the holes have been re-sized by a method in accordance with an aspect of this invention.

The present invention will be described in reference to a fuel nozzle assembly vane 22 that is represented in FIG. 4 with a cross-sectional view similar to the prior art vane 22 of FIG. 3. As such, the vane 22 is a component of a fuel nozzle assembly of a gas turbine engine, and may be similar or equivalent to any one of the vanes 22 of the fuel nozzle assembly 10 represented in FIGS. 1, 2 and 3. Although the invention is described herein with reference to the vane 22 of a fuel nozzle assembly, it will be appreciated that other applications are foreseeable and within the scope of the invention. For example, the present invention is generally applicable to resizing holes whose cross-sectional areas are desired to be carefully controlled, particularly in complex devices where resizing of interior holes can be expensive and time consuming, as well as various types of assemblies in which resizing of holes using a welding technique or other high temperature operation could pose a risk to whose braze joints used to join components of the assembly together. In addition, it is foreseeable that the present invention is further generally applicable to build up of any flow path surface that is part of a controlled flow gap between mating parts, for example, concentric cylinders, to improve clearances required for efficient flows.

As represented in FIG. 4, the vane 22 includes a pair of radially spaced outer premix fuel supply holes 42 through one wall 36 of the vane 22 and a single outer premix fuel supply hole 42 through the opposite side wall 38 of the vane 22. The vane 22 is formed of a metal or alloy which can be diffusion coated with aluminum. Preferably, the vane 22 is a nickel-, cobalt- or iron-based superalloy.

The supply holes 42 are represented as being the result of resizing pre-existing holes 24 in accordance with a preferred embodiment of the invention. As previously discussed, the pre-existing holes 24 may have become oversized due to wear or a mistake in original orifice dimensions which can leave the vane 22 unusable. In order to reduce the inner diameter of the pre-existing holes 24, an adherent diffusion aluminide coating 50 is represented as having been formed on the interior surfaces of the holes 24, as represented in FIG. 4. As the thickness of the coating 50 increases, the final diameters of the holes 42 decrease. This allows the holes 24 to be selectively entirely closed or have their inner diameters reduced. If the holes 24 are closed entirely, the desired resized holes 42 may be drilled by conventional means known in the art. However, according to a preferred aspect of the invention, the thickness of the coating 50 deposited in each hole 24 can be controlled to controllably reduce its cross-sectional area (diameter, if its cross-sectional shape is round) to a desired size, thereby avoiding any additional processing of the holes 42 to attain their desired cross-sectional areas. The preferred formation of the coating 50 as a method of resizing the holes 24 has the advantage of not requiring conventional techniques such as welding which may be difficult to perform without potentially distressing or cracking the base material of the vane 22.

According to a preferred aspect of the invention, the coating 50 is an outward-type coating, that is, a coating that is formed under conditions that promote an outward diffusion of a metal from the substrate, for example, nickel, into a deposited aluminum-containing composition to form an additive layer, and also reduce the inward diffusion of aluminum from the deposited aluminum-containing composition into the substrate, resulting in a relatively thick additive layer above the original surface of the substrate.

More specifically, the aluminum-containing composition includes an aluminum alloy with a melting temperature that is higher than aluminum, so that the majority of the gaseous aluminum species forms at temperatures sufficiently high for metal constituents within the substrate of the vane 22 to be actively diffused outward. This produces an acceptable balance of inward and mostly outward diffused coating. At a temperature of 760° C. or more substantially pure aluminum (as most slurry coating compositions contain) would diffuse into the surfaces of the holes 24, prior to diffusion of metal constituents within the substrate out of the vane 22. If the vane 22 is nickel-based, the inward diffused aluminum would react with the nickel to form a diffusion area within near-surface substrate regions of the vane 22 that contains nickel aluminide intermetallic compounds. In contrast, with preferred aluminum-containing compositions used with the present invention, which intentionally contain one or more aluminum alloys with a melting temperature that is higher than aluminum, gaseous aluminum species form at temperatures (e.g., greater than or equal to 1065° C. (about 1940° F.)) that promote the majority of coating formation to be outward from the interior surfaces of the holes 24. The nickel moves into the precursor coating where it reacts and combines with the gaseous aluminum species to form an outward-type diffusion coating. Since the majority of the coating formation is outward from the interior surfaces of the holes 24, the properties of the underlying vane 22 remains relatively unchanged.

As previously stated, the aluminum-containing composition comprises an aluminum alloy with a higher melting temperature than aluminum (melting point of about 660° C.). Particularly suitable compositions include metallic aluminum alloyed with chromium, cobalt, iron, and/or another aluminum alloying agent with a sufficiently higher melting point so that the alloying agent does not deposit during the diffusion process, but instead serves as an inert carrier for the aluminum of the composition. The aluminum alloy (Al-M, wherein M is a metallic element such as chromium, cobalt, iron, etc.) of the aluminum-containing composition can have a concentration of about 20 wt % to about 70 wt % Al, preferably about 30 wt % to about 60 wt % Al, and more preferably about 35 wt % to about 50 wt % Al (the balance M and incidental impurities).

The aluminum-containing composition is preferably in the form of a slurry or gel. In this situation, the aluminum alloy can be in the form of a powder having various particle sizes. For example, all particles of the powder can have a size (as measured along a major axis) of less than or equal to about 125 micrometers, preferably about 30 micrometers to about 120 micrometers, more preferably about 40 micrometers to about 80 micrometers, and most preferably about 40 micrometers to about 60 micrometers.

The aluminum-containing composition contains one or more activators that facilitate the liberation of the aluminum, that is, the separation of the aluminum from the alloy and the formation of gaseous aluminum species therefrom, at a temperature greater than or equal to the temperature that facilitates the majority of the coating formation to be outward from the interior surfaces of the holes 24. Possible activators include halides such as aluminum chloride ($NH_4Cl$), aluminum fluoride ($NH_4F$), and ammonium bromide ($NH_4Br$), which produce an aluminum halide as the gaseous aluminum species, though the use of other halide activators is also believed to be possible.

The activator may suitably serve as a binder capable of adhering the aluminum-containing composition to the interior surfaces of the holes 24. Alternatively or in addition, the aluminum-containing composition can further comprise one or more binders for this purpose. Suitable additional/alternative binders preferably consist essentially or entirely of alcohol-based or water-based organic polymers. A preferred aspect of the invention is that any additional binder present in the aluminum-containing composition is able to burn off entirely and cleanly at temperatures below that required to vaporize and react the halide activator, with the remaining residue being essentially in the form of an ash that can be easily removed.

Preferred slurry or gel compositions contain the aluminum alloy powder and the activator in an amount of about 10 to about 80 weight percent, with the balance being the additional binder. Particularly suitable slurry compositions for use with this invention contain, by weight, about 35 to about 65% aluminum alloy powder, about 25 to about 60% binder, and about 1 to about 25% activator. More preferred ranges are, by weight, about 35 to about 65% aluminum alloy powder, about 25 to about 50% binder, and about 5 to about 25% activator. These ranges allow the slurry to be applied to the interior surfaces of the holes 24 by a variety of methods.

In order to apply the slurry or gel to the hole 24, the vane 22 must first be removed from the fuel nozzle assembly. The slurry or gel may then be applied by any means known in the art. Suitable examples include, but are not limited to, manual application with a brush, spatula, eye dropper, swab, or needle, as well as application by submersion, air brush, or other spraying means. Once coated with the aluminum-containing composition, the vane 22 is heated and held at an elevated temperature until the coating 50 has achieved a desired thickness. A sufficient time and temperature for the diffusion process will depend on the aluminum-containing composition used; however, a temperature greater than or equal to about 1065° C. (about 1940° F.) is preferable for vanes 22 composed of materials such as nickel, cobalt, and/or iron. At about this temperature, the activator preferably reacts with the aluminum alloy of the aluminum-containing composition to form a gaseous aluminum species and the nickel, cobalt, and/or iron from the superalloy is sufficiently diffused outward. This environment at the surface then reacts to reform and deposit an aluminide on the interior surfaces of the holes 24.

Figure 5:
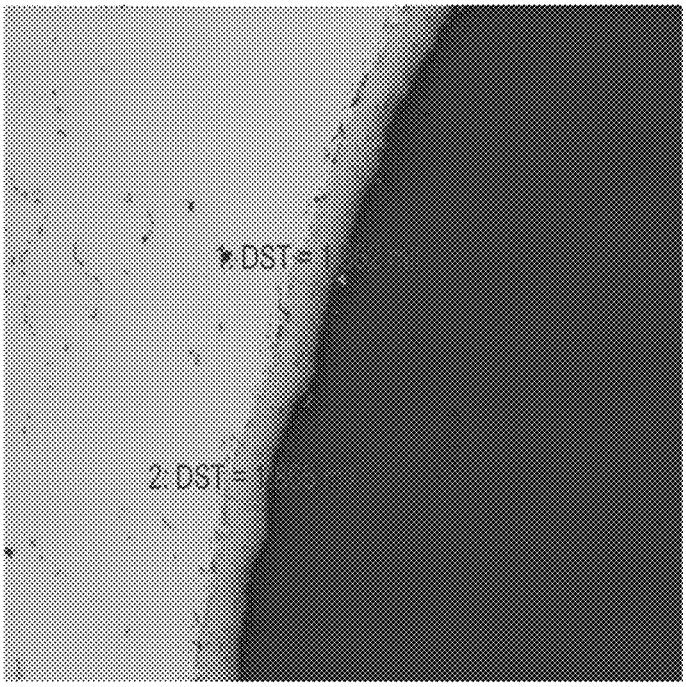
FIG. 5 is a scanned image showing a cross-section of a premix fuel supply hole that was re-sized using a method in accordance with an aspect of this invention.

By forming the coating 50 in the above described manner, the decrease in the inner diameter of the holes 24 can be tailored by adjusting the composition or thickness of the aluminum-containing composition and/or adjusting the time and/or temperature of the heating of the vane 22. For example, FIG. 5 is a scanned image showing a cross-section of a coating on an Inconel 625, a well-known solid solution-strengthened nickel-base superalloy, combustion fuel nozzle passage that was applied using a method in accordance with an aspect of this invention. A gel slurry comprising 60% alloy, 10% activator and 30% gel binder was applied to the passage by a small brush. Subsequently, the vane was held at 2050° F. (about 1120° C.) for about 2 hours to facilitate both aluminum gas formation and outward nickel diffusion. This controlled thickness could further be increased by increasing the content of the alloy and/or the activator in the gel slurry or by increasing the heat treatment temperature. The resulting increase in thickness of the coating is believed to be dependent to the superalloy being coated. In addition, where holes are reduced in size such that the resulting flows are lower than desired, the holes may be slightly increased in diameter using precision reamers (tolerance of +/−0.0005 inches (about 13 micrometers)) to achieve the desired flow.

Figure 6:
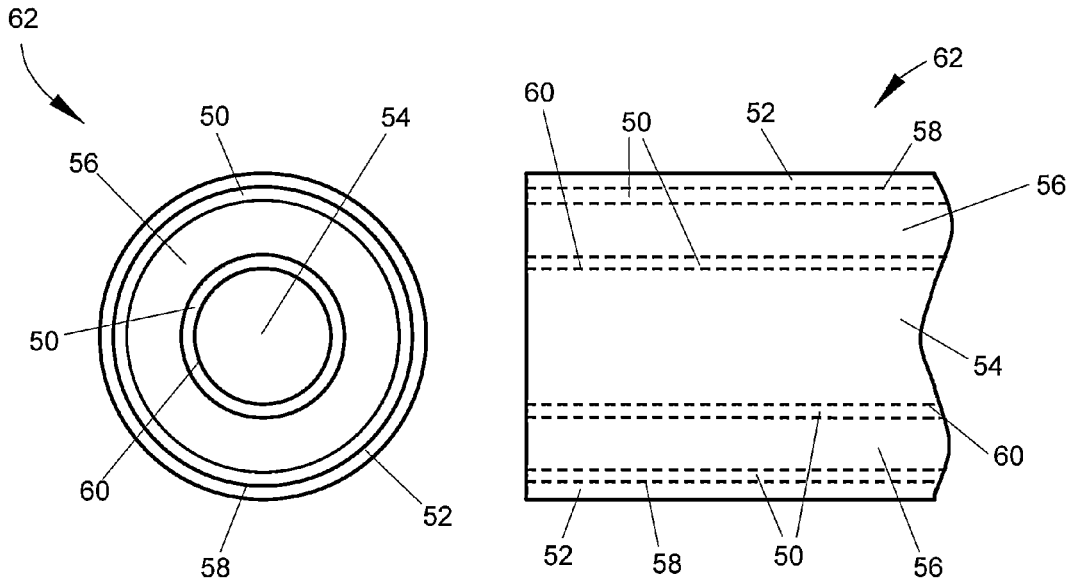
FIG. 6 is cross-sectional end and side views of a component comprising two concentric cylinders wherein a flow path therebetween the cylinders has been re-sized by a method in accordance with an aspect of this invention.

According to an alternative embodiment of the present invention, FIG. 6 is end and side views representing a component 62 comprising two concentric cylinders, a first cylinder 52 and a second cylinder 54, with a flow path 56 therebetween. The component 62 further comprises the coating 50 formed on an interior surface 58 of the first cylinder 52 and on an exterior surface 60 of the second cylinder 54. Similar to the holes 24 of the vane 22 described above, the thickness of the coating 50 on the component 62 may be adjusted to re-size the flow path 56. The coating 50 may be applied to the interior surface 58, the exterior surface 60, or both surfaces 58 and 60 as shown in FIG. 6.

While the invention has been described in terms of specific embodiments, it is apparent that other forms could be adopted by one skilled in the art. For example, the physical configuration of the holes could differ from that shown, and materials and processes other than those noted could be used. In addition, the use of an outwardly grown aluminide coating can add thickness to the exterior surface of a superalloy component. By this means gaps or channels can also be tailored or repaired to meet flow requirements. Therefore, the scope of the invention is to be limited only by the following claims.

The invention claimed is:

1. A method of reducing a cross-sectional area of a hole in a component of a complex device to a predetermined cross-sectional area, the method comprising:

operating the complex device with the component;

removing the component from the complex device, the cross-sectional area of the hole being in an oversized condition relative to the predetermined cross-sectional area as a result of wear caused by the operation of the complex device;

preparing a composition comprising at least an aluminum alloy with a melting temperature higher than aluminum;

applying the composition to an interior surface of the hole; and then heating the component to a temperature to cause a metal within the component to diffuse from the component into the composition and react with the aluminum alloy in the composition to form a coating on the interior surface of the hole, the heating step being performed for a duration until the coating is sufficiently thick to selectively decrease the cross-sectional area of the hole and thereby directly attain the predetermined cross-sectional area for the hole, the decrease in the cross-sectional area being tailored by adjusting at least one of the temperature and duration of the heating step.

2. The method of claim 1, wherein the composition is a slurry comprising a powder containing a metallic aluminum alloy having a melting temperature higher than aluminum, an activator capable of forming a reactive halide vapor with aluminum in the aluminum alloy, and a binder containing at least one organic polymer.

3. The method of claim 2, wherein the heating of the component burns off the binder, vaporizes and reacts the activator with the metallic aluminum to form the halide vapor, reacts the halide vapor at the surfaces of the component to deposit aluminum on the surfaces, and diffuses the deposited aluminum into the surfaces of the component to form a coating, wherein the binder burns off to form a readily removable ash residue.

4. The method of claim 2, wherein the powder consists essentially of a chromium-aluminum alloy.

5. The method of claim 2, wherein the slurry consists essentially of, by weight, about 35 to about 65% of the powder, about 1 to about 25% of the activator, and about 25 to about 60% of the binder.

6. The method of claim 1, wherein the component is heated to a temperature of at least about 1940° F. (about 1065° C.).

7. The method of claim 1, wherein the component is a fuel nozzle assembly and the complex device is a gas turbine.

8. The method of claim 1, wherein the component is a nickel-based superalloy.

9. A method of tuning a fuel nozzle assembly for a gas turbine having a plurality of circumferentially spaced vanes with holes through walls of the vanes for flowing fuel for premixing with air within the nozzle assembly, the method comprising:

preparing a composition comprising at least an aluminum alloy with a melting temperature higher than aluminum;

applying the composition to an interior surface of at least a first of the holes within an individual vane of the plurality of vanes, the first hole being in an oversized condition relative to a predetermined cross-sectional area for the first hole that causes fuel flowing therethrough to flow at a flow rate that is higher than a predetermined flow rate for the first hole; and then heating the vane to a temperature to cause a metal within the vane to diffuse from the vane into the composition and react with the aluminum alloy in the composition to form a coating on the interior surface of the first hole, the heating step being performed for a duration until the coating is sufficiently thick to selectively decrease the cross-sectional area of the first hole and thereby directly attain the predetermined flow rate for the hole, the decrease in the cross-sectional area being tailored by adjusting at least one of the temperature and duration of the heating step.

10. The method of claim 9, wherein the composition is a slurry comprising a powder containing a metallic aluminum alloy having a melting temperature higher than aluminum, an activator capable of forming a reactive halide vapor with aluminum in the aluminum alloy, and a binder containing at least one organic polymer.

11. The method of claim 9, wherein the heating of the component burns off the binder, vaporizes and reacts the activator with the metallic aluminum to form the halide vapor, reacts the halide vapor at the surfaces of the component to deposit aluminum on the surfaces, and diffuses the deposited aluminum into the surfaces of the component to form a coating, wherein the binder burns off to form a readily removable ash residue.

12. The method of claim 10, wherein the powder consists essentially of a chromium-aluminum alloy.

13. The method of claim 10, wherein the slurry consists essentially of, by weight, about 35 to about 65% of the powder, about 1 to about 25% of the activator, and about 25 to about 60% of the binder.

14. The method of claim 9, wherein the component is heated to a temperature of at least about 1940° F. (about 1065° C.).

15. The method of claim 9, wherein prior to the application step, the method comprises:

operating the gas turbine with the fuel nozzle assembly; and removing the fuel nozzle assembly from the gas turbine, the oversized condition of the first hole being a result of wear caused by the operation of the gas turbine;

the applying and heating steps being performed without disassembling the fuel nozzle assembly.

16. The method of claim 15, wherein the fuel nozzle assembly is a brazed assembly and the method is performed without damaging brazements thereof.

17. The method of claim 9, wherein prior to the application step the method comprises fabricating the fuel nozzle assembly to produce the oversized condition of the first hole, and wherein the applying and heating steps are performed without disassembling the fuel nozzle assembly.

18. The method of claim 17, wherein the fuel nozzle assembly is a brazed assembly and the method is performed without damaging brazements thereof.

19. A method of reducing a cross-sectional area of a flow path defined as a gap between at least two mating components to a predetermined cross-sectional area, the method comprising:

preparing a composition comprising at least an aluminum alloy with a melting temperature higher than aluminum;

applying the composition to an interior surface of a first component of the two mating components and/or an exterior surface of a second component of the two mating components to yield coated components, the interior surface of the first component and the exterior surface of the second component defining the gap between the first and second components and the flow path and the cross-sectional area thereof, the gap being in an oversized condition relative to the predetermined cross-sectional area that results in a flow rate through the flow path that is higher than a predetermined flow rate for the flow path; and then heating the coated components to a temperature to cause a metal within the coated components to diffuse from the coated components into the composition and react with the aluminum alloy in the composition to form a coating on the interior surface of the first component and/or the exterior surface of the second component, the heating step being performed for a duration until the coating is sufficiently thick to selectively decrease the cross-sectional area of the flow path and thereby directly attain the predetermined cross-sectional area and the predetermined flow rate of the flow path, the decrease in the cross-sectional area being tailored by adjusting at least one of the temperature and duration of the heating step.

20. The method of claim 19, wherein the composition is a slurry comprising a powder containing a metallic aluminum alloy having a melting temperature higher than aluminum, an activator capable of forming a reactive halide vapor with aluminum in the aluminum alloy, and a binder containing at least one organic polymer.

* * * * *